US006564756B1

(12) United States Patent
Rayes

(10) Patent No.: US 6,564,756 B1
(45) Date of Patent: May 20, 2003

(54) FIRETUBE BOILER

(76) Inventor: Andre Rayes, 9520 Tripp Ave., Skokie, IL (US) 60076

( * ) Notice: Subject to any disclaimer, the term of this patent is extended or adjusted under 35 U.S.C. 154(b) by 0 days.

(21) Appl. No.: 10/096,761

(22) Filed: Mar. 12, 2002

(51) Int. Cl.[7] ..... F22B 7/12

(52) U.S. Cl. ..... 122/149; 122/68; 122/47; 122/110

(58) Field of Search ..... 122/44.1, 51, 53, 122/68, 18.3, 266, 95.1, 47, 70, 75, 110–111, 136 R, 149

(56) References Cited

U.S. PATENT DOCUMENTS

| | | | | | |
|---|---|---|---|---|---|
| 2,146,565 | A | * | 2/1939 | Curtis | 122/149 |
| 2,548,287 | A | * | 4/1951 | Blake, Jr. | 122/75 |
| 3,368,531 | A | * | 2/1968 | Fehr | 122/136 R |
| 4,203,392 | A | * | 5/1980 | McLane | 122/18.3 |
| 4,651,714 | A | * | 3/1987 | Granberg | 122/18.3 |

* cited by examiner

*Primary Examiner*—Gregory Wilson
(74) *Attorney, Agent, or Firm*—Patzik, Frank & Samotny Ltd.

(57) ABSTRACT

A boiler for generating steam and/or hot water is provided having a tank containing water, an outlet located proximal to the top of the tank, and a return inlet located proximal to the bottom of the tank. A substantially horizontal combustion conduit in heat transfer relationship with the water extends through the tank proximal to the outlet. A heat source in communication with the combustion conduit heats and drives the heated gas into the combustion conduit. A set of fire conduits in heat transfer relationship with the water and in communication with the combustion conduit, extend though said tank below the combustion conduit. When heated gas is driven into the combustion conduit, the heated gas flows through the combustion conduit, and then flows downwardly and then in a substantially transverse through the fire conduits, and heat is transferred to the water as the heated gas flows through the combustion conduit and fire conduits.

24 Claims, 5 Drawing Sheets

FIRETUBE BOILER

FIELD OF THE INVENTION

The present invention relates generally to a boiler, and specifically to a once-through firetube boiler for generating steam and/or hot water.

BACKGROUND ART

Most buildings have a system for generating heat, and for distributing heat throughout the internal portions of the building. One method by which a building can be heated is by circulating steam or hot water through pipes in the building. A system that operates by this method is commonly referred to as a "hydronic" heating system. Hydronic heating systems typically employ a heat exchanger (e.g. a boiler) to generate the steam or hot water.

One type of boiler, commonly referred to as a "firetube" boiler, generates a hot flue gas, and passes the flue gas through firetubes that extend through a water-filled closed vessel. As the flue gas passes through the firetubes, heat is transferred by convection and radiation from the flue gas to the water, thus generating heated water or steam. The heated water or steam is then extracted from the top of the boiler, and transferred throughout the building through a series of pipes. As the hot water or steam passes through the pipes throughout the building, heat is transferred from the water or steam to the air surrounding the pipes, thus heating the building.

Conventional boilers typically include several arrangements or bundles of firetubes through which the flue gas travels back and forth. For example, if a boiler includes two bundles of firetubes, the flue gas passes in one direction through a first bundle of firetubes, and then in an opposite direction through a second bundle of firetubes. This type of arrangement is commonly referred to as a "two-pass" boiler. Generally, the flue gas is formed in a combustion chamber in heat transfer relationship with the water that is located near the bottom of the vessel. Flue gas is directed from the combustion chamber through the firetubes in a generally upward direction. As the flue gas travels upward through the firetubes, the flue gas cools.

However, conventional firetube boilers are inadequate for heating a building in a short amount of time, because all of the water in the vessel must be heated to a certain temperature before steam forms, or before the water is of a sufficient temperature to heat the building. Also, far more water may be heated than is necessary to heat the building to the desired temperature, thus wasting fuel. Furthermore, conventional firetube boilers are, inadequate for maintaining the heat in a building within a narrow temperature range, because once the desired temperature within the building is reached, a conventional boiler will often continue to output steam or hot water long after flue gas has ceased to flow through the firetubes. This is due to the fact that all of the water in the boiler must cool to a certain temperature before steam or hot water output ceases.

Therefore, it is a first object of the present invention to provide an apparatus for heating a building in a relatively short amount of time.

Another object of the present invention is to provide a hydronic heating system capable of providing steam or hot water in a relatively short amount of time.

Yet another object of the present invention is to provide a boiler capable of maintaining the temperature within a building within a narrow temperature range.

An additional object of the present invention is to provide a boiler having a combustion chamber located proximal to the main steam or water outlet.

Yet another object of the present invention is to provide a boiler that has dividers positioned within the vessel for impeding the flow of water contained therein.

It is a further object of the present invention is to provide a boiler that has a low cost of operation, and is easy and economical to manufacture.

SUMMARY OF THE INVENTION

The above-listed objects are met or exceeded by the present apparatus for to generating steam and/or hot water heating water using a heated gas. A boiler is provided having a tank for holding the water. Steam or hot water is extracted from the boiler through an outlet located proximal to the top of the tank, and cooled water returns to the boiler through an inlet located proximal to the bottom of the tank.

A substantially horizontal combustion conduit in heat transfer relationship with the water extends through the tank proximal to the outlet. A heat source in communication with the combustion conduit heats and drives the heated gas into the combustion conduit. A set of substantially horizontal fire conduits in communication with the combustion conduit extend though said tank below the combustion conduit, in heat transfer relationship with the water. When the heated gas is driven into the combustion conduit in a first direction, the heated gas flows through the combustion conduit, flows down and into the fire conduits, and then flows through the fire conduits in a second substantially transverse direction, and heat is transferred to the water as the heated gas flows through the combustion conduit and the fire conduits.

BRIEF DESCRIPTION OF THE DRAWINGS

Other objects and advantages of the invention will become apparent upon reading the following detailed description and upon reference to the drawings in which.

WRITTEN DESCRIPTION OF THE INVENTION

Figure 1:
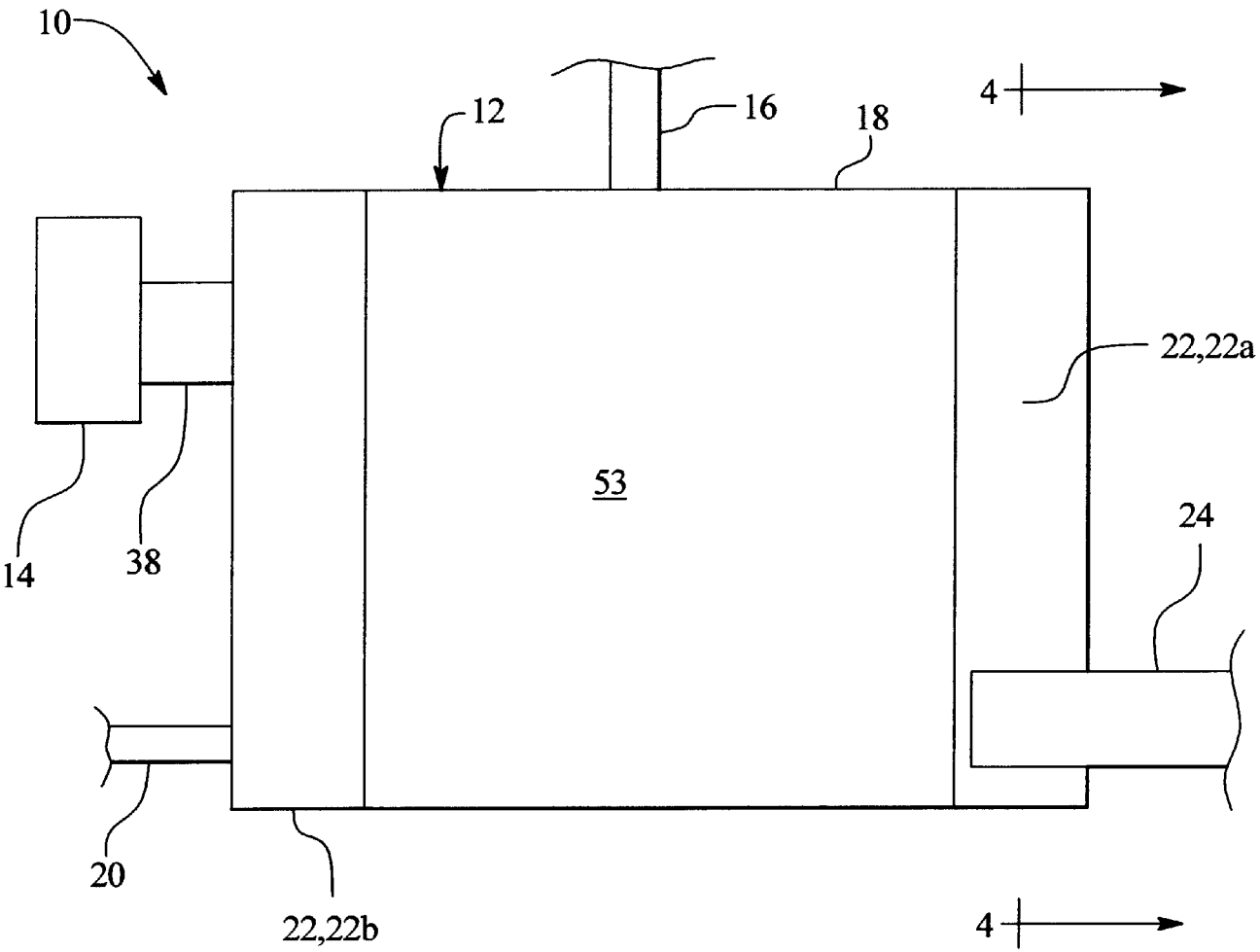
FIG. 1 is front-view of the boiler of the present invention.

While this invention is susceptible of embodiment in many different forms, there is shown in the drawings and will herein be described in detail one specific embodiment, with the understanding that the present disclosure is to be considered merely an exemplification of the principles of the invention and is not intended to limit the invention to the embodiment illustrated.

Figure 2:
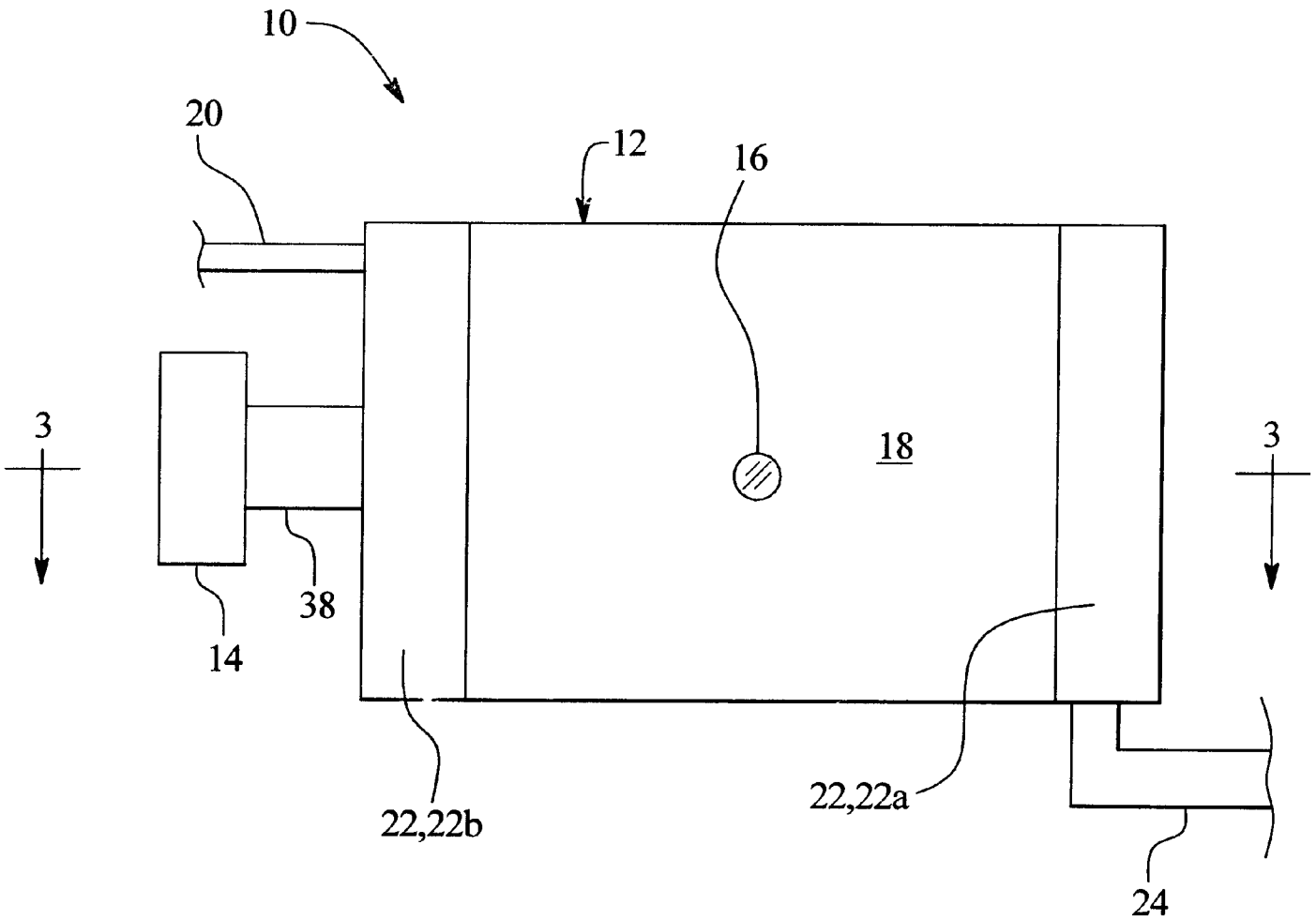
FIG. 2 is a top-view of the boiler.

Referring to FIGS. 1 and 2, a once-through firetube boiler 10 of the present invention includes a tank 12 for holding a heat transfer medium.

Preferably, the heat transfer medium is a liquid, most preferably water. An alternate heat transfer medium may be employed, and which heat transfer medium is employed may depend upon the desired heat output of the boiler 10.

Heating means in heat transfer relationship with the water heats the water. In one embodiment, the heating means includes a heat source 14 for heating a gas (e.g. atmospheric air), thereby generating a heated flue gas, and for driving the heated flue gas through a series of conduits (discussed more fully below) that are in heat transfer relationship with the water.

Preferably, the heat source 14 is a combustible fuel-fired burner. The combustible fuel employed may be any flammable or combustible gas, solid or liquid material. Examples of such a combustible fuel include, but are not limited to: a petroleum gas such as natural gas or methane, propane or the like; coal; a petroleum liquid such as fuel oil; liquefied petroleum gas; refinery gas; distillate oil; residual oil; and a combination natural gas/fuel oil fuel. Alternate combustible fuels may be employed, and one with ordinary skill in the art could readily choose a fuel that is appropriate for producing the desired heat output of the heat source 14.

A forced draft subassembly (not shown) regulates the flow of gas to the burner so that the proper ratio of oxygen-to-fuel can be attained, and forces or drives the heated flue gas into the boiler 10. Preferably, the forced draft subassembly includes a fan or blower (not shown) for drawing gas into the burner, and for forcing or driving the heated flue gas into the boiler 10.

Referring again to FIGS. 1 and 2, the tank 12 includes an outlet 16 located proximal to the upper portion of the tank 12, most preferably at the center of the top 18 of the tank 12. In operation, the heated water exits the tank 12 through the outlet 16, and cool water returns to the tank 12 through a return inlet 20 located proximal to the bottom portion of the tank 12.

Opposing end caps 22 operably associated with the tank 12 provide a means for substantially containing and directing the flow of the flue gas as it flows throughout the boiler 10. Preferably, the end caps 22 are removable, thereby providing access to the conduits within the boiler 10 for maintenance purposes. The end caps 22 may be lined with an insulator such as a refractory cement or the like. Such materials are commercially available, and one with ordinary skill in art could readily choose a heat retaining material suitable for lining the end caps 22.

The end caps 22 and the tank 12 are preferably constructed from a metal, most preferably boiler steel. Such materials are readily commercially available, and one with ordinary skill in art could readily choose a material suitable for use in constructing a boiler 10 in accordance with the teachings presented herein.

A flue gas exhaust 24 extends from one of the end caps 22, proximal to the bottom of the boiler 10. Flue gas exits the boiler 10 through the exhaust 24, and from there the spent flue gas can be piped to another boiler (not shown) for further use, piped to a processing apparatus (not shown) for processing (i.e. for removal of certain components of the gas where desired), and/or may be released into the atmosphere.

Figure 3:
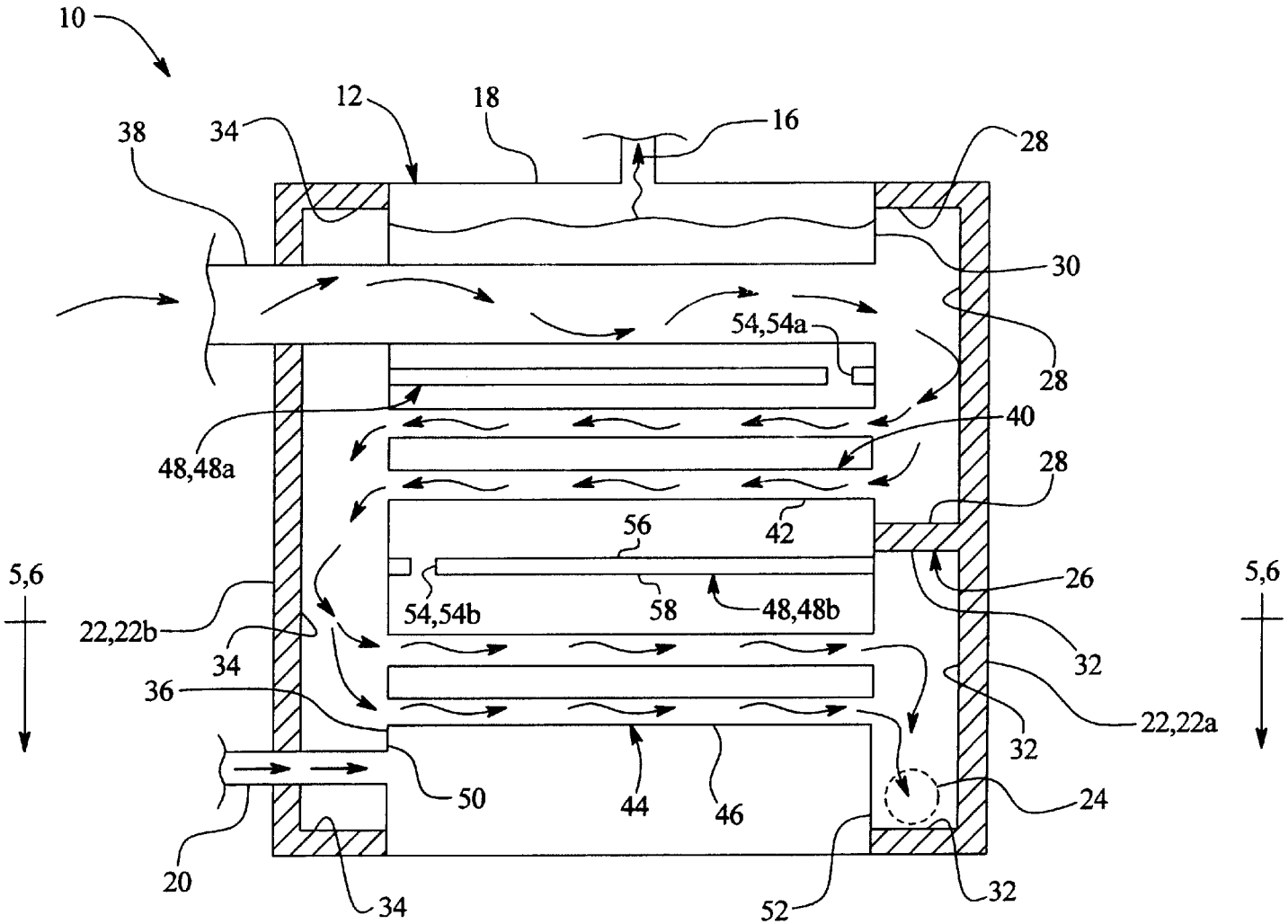
FIG. 3 is a cross-sectional view of the boiler taken along line 3—3 of FIG. 2.
Figure 4:
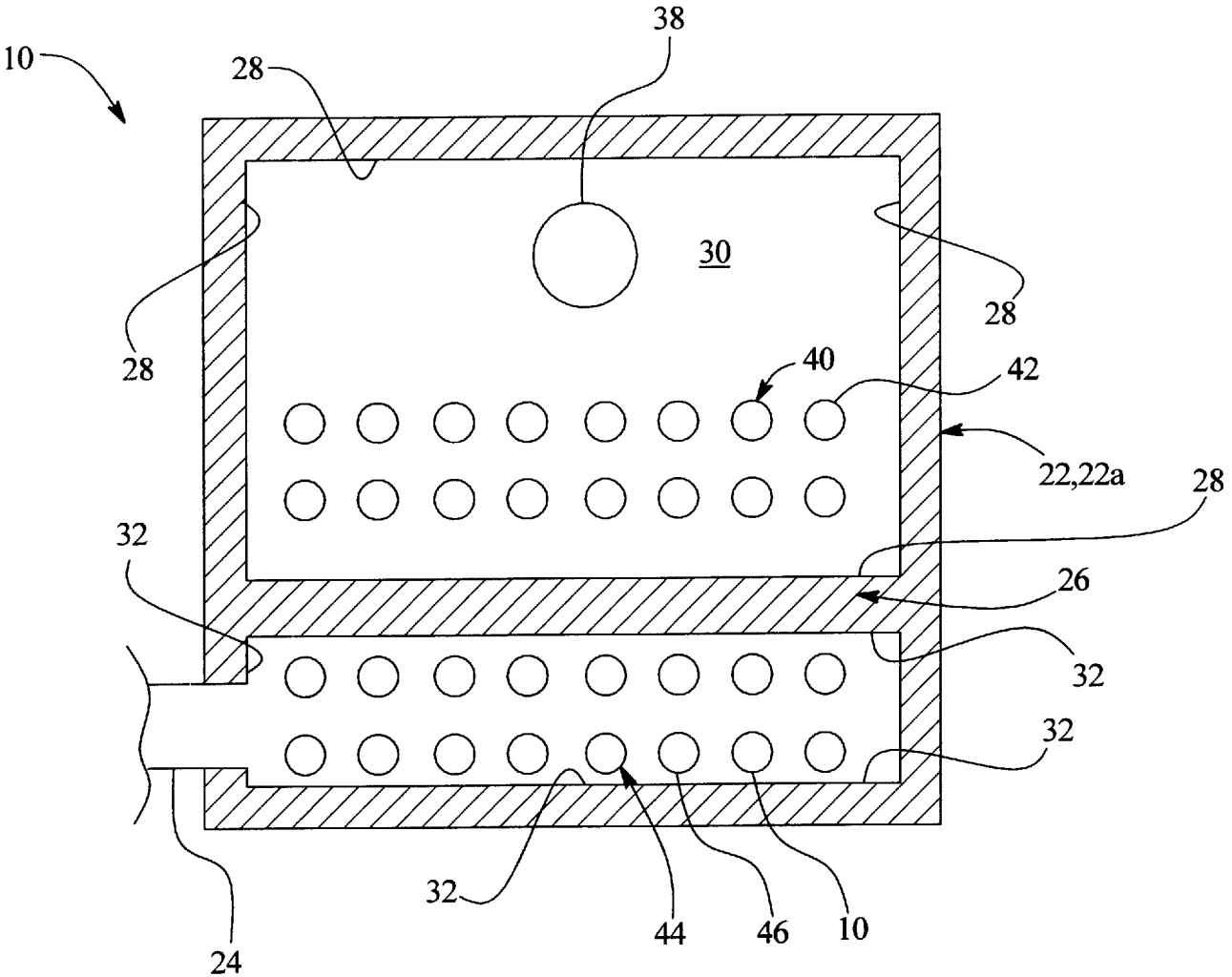
FIG. 4 is a cross-sectional view of the boiler taken along line 4–4 of FIG. 1.

Referring to FIGS. 3 and 4 in combination, one embodiment of the boiler 10 of the present invention is shown and will now be discussed. FIG. 3 is a cross-sectional diagram of the boiler 10 taken along line 3—3 of FIG. 2. FIG. 4 is a cross-sectional diagram of the boiler 10 taken along line 4—4 of FIG. 1. In this embodiment, the boiler 10 is a once-through, two-pass boiler 10. However, the invention is not so limited, as alternate embodiments are contemplated wherein a three-pass boiler 10, a four-pass boiler 10, a five-pass boiler 10 or the like, is provided.

The boiler 10 of this embodiment includes a divided end cap 22*a* and a non-divided end cap 22*b*. The divided end cap 22*a* includes a horizontally extending divider member 26 for dividing the interior region of the end cap 22*a* into an upper chamber and a lower chamber. The upper chamber is defined by the those internal surfaces of the divided end cap 22*a* indicated in FIGS. 3 and 4 as reference number 28, in combination with the upper portion of the tank right side wall 30. The lower chamber is defined by those internal surface of the divided end cap 22*a* indicated in FIG. 4 as reference number 32, in combination with the lower portion of the tank right side wall 30. The non-divided end cap 22*b* includes a single, continuous chamber defined by the internal surfaces 34 of the non-divided end cap 22*b*, in combination with the tank left side wall 36.

As noted above, the heated flue gas from the heat source 14 (see FIGS. 1 and 2) is forced or driven through a series of conduits that are in heat transfer relationship with the water. In the preferred embodiment, the greatest amount of heat transfer between the flue gas and the water occurs proximal to the outlet 16. In the embodiment shown in FIG. 3, a substantially horizontal combustion conduit or Morrison tube 38 in communication with the heat source 14 and in heat transfer relationship with the water, extends horizontally through the tank 12 proximal to the upper-most portion of the tank 12, and therefore proximal to the outlet 16. A burner quarl (not shown) may be provided at the junction of the heat source 14 and the combustion conduit 38 so as to substantially prevent unwanted vortex generation.

By positioning the combustion conduit 38 proximal to the upper portion of the tank 12, the greatest amount of heat transfer between the heated flue gas and the water occurs proximal to the outlet 16. By so positioning the combustion conduit 38, water can be heated to a temperature sufficient for use in a relatively shorter amount of time as compared to conventional boilers of similar construction. This is possible because, unlike a conventional boiler, all of the water contained within the vessel 12 of the boiler 10 of the present invention need not be heated to the requisite temperature before the water can be used. Rather, only the portion of the water that is proximal to the outlet 16 needs to be heated to the requisite temperature. Furthermore, because a smaller volume of the water is heated as compared to a conventional boiler of similar construction, less fuel is used overall.

In addition, by heating only the portion of the water that is proximal to the outlet 16, the temperature within the building can be maintained within a range of temperatures that is narrower than a conventional boiler. This is because not all of the water within the boiler 10 needs to be heated before usable heated water is generated, and because not all of the water in the boiler 10 needs to cool to a temperature sufficient to cease heat output. Furthermore, the heated water can be cooled by cooler water located distal from the output 16.

The flue gas flows through the combustion conduit 38 in a substantially horizontal first direction. Flue gas exits or flows from the combustion conduit 38, enters the upper chamber of the divided end cap 22*a*, and reflects off the first chamber internal surfaces 28,30 so as to flow transversely in a second direction. Flue gas flowing in the second direction flows from the upper chamber and into a first set of fire conduits, collectively indicated in FIGS. 3 and 4 as reference number 40. The first set of conduits 40 includes a plurality of fire conduits 42, each extending in substantially horizontally through the tank 12 in heat transfer relationship with the water. In addition, each fire conduit 42 may optionally be downwardly angled relative to the natural direction of the flow of the flue gas, preferably at an angle between approximately 1 and approximately 45 degrees relative to combustion conduit 38. By positioning the fire conduits 42 below the combustion conduit 38, the flue gas is forced to travel in a direction opposite the direction a hot gas normally tends to flow, namely upward. By forcing the flue gas to travel in a direction opposite the direction the flue gas naturally tends to flow, the flue gas is retained within the boiler 10 for a relatively longer period of time than a conventional boiler of similar construction, and thus a greater amount of heat transfer between the flue gas and the water can be achieved before the flue gas is discharged from the boiler 10.

As noted above, the flue gas flows through the first set of fire conduits 40 in the second direction. Flue gas exits or flows from the first set of fire conduits 40, enters the chamber of the non-divided end cap 22*b*, and reflects off the chamber internal surfaces 34 so as to flow transversely in the first direction. Flue gas flowing in the first direction flows from the chamber and into a second set of fire conduits, collectively indicated in FIGS. 3 and 4 as reference number 44.

The second set of conduits 44 includes a plurality of fire conduits 46, each extending substantially horizontally through the tank 12 in heat transfer relationship with the water. In addition, each fire conduit 46 may optionally be downwardly angled relative to the natural direction of the flow of the flue gas.

The flue gas flows from the second set of conduits 44 into the lower chamber of the divided end cap 22*a*, and into the exhaust 24.

Horizontally extending water divider means is provided for substantially dividing the water into two or more regions, and for restricting the flow of the water there between. Preferably, the divider means is employed to divide the water so as to provide for one region surrounding the combustion conduit 38, and to provide for one region per set of fire conduits. Preferably, the divider means does not completely restrict the flow of water between regions., Rather, the divider means impedes the flow between regions, so that the warmest portion of the water can be substantially retained proximal to the outlet 16, and therefore the water can be heated to a temperature sufficient for use in a relatively shorter amount of time.

Referring to FIG. 4, in one preferred embodiment the divider means is a divider member 48. The divider member 48 is fixedly attached to the internal surfaces 50,52 of the tank left and right end walls 36,30, respectively. The divider member 48 is also fixedly attached to the internal surfaces (not shown) of the tank front wall 53 (see FIG. 1) and rear wall (not shown).

One or more divider member apertures defined by edge 54 extend through the divider member 48. It is through this aperture 54 that the water flows from region-to-region, as discussed more fully herein below.

In a preferred embodiment, the divider member 48 includes two parallel sheets 56,58 having an insulator (e.g. a heat transfer inhibiting gas, an insulation material, an evacuated region or the like) there between.

Vertically extending stabilizer rods (not shown) may be provided for substantially inhibiting flexure of the sheets 56,58. Preferably, each stabilizer rod includes opposing ends (not shown) wherein one end is fixedly connected to one of the sheets and the other end is fixedly connecting to the opposing sheet. An inspection aperture (not shown) extends through either the right or left side wall 30,36, respectively, at a location corresponding to the space between the sheets 56,58. The inspection aperture may be sealed with a removable cap (not shown) or with a transparent material. Inspection of the space can then be made by either viewing the space through the transparent material, or by removing the plug and peering through the aperture.

Referring again to the specific embodiment depicted in FIGS. 3 and 4, namely the once-through two-pass boiler 10, the boiler 10 of this embodiment includes a first or upper divider member 48*a* and a second or lower divider member 48*b*. The upper divider member 48*a* is positioned between the combustion conduit 38 and the first set of fire conduits 40. The lower divider member 48*b* is positioned between the first set of fire conduits 40 and the second set of fire conduits 46. The upper and lower divider members 48*a*,48*b* divide the water into three regions, namely, an upper region located above the upper divider member 48*a*, a central region located between the two divider members 48*a*,48*b*, and a lower region located below the lower divider member 48*b*.

The upper and lower divider members 48*a*,48*b* are each provided with at least one aperture 54*a*,54*b*, respectively. In this embodiment, the apertures 54*a*,54*b* are preferably distally located with respect to one another. Staggering the apertures 54*a*,54*b* as such substantially impedes the flow of the water to and from the central region. Furthermore, it is preferred that the lower divider member aperture 54*b* be located above the water return outlet.

Figure 6:
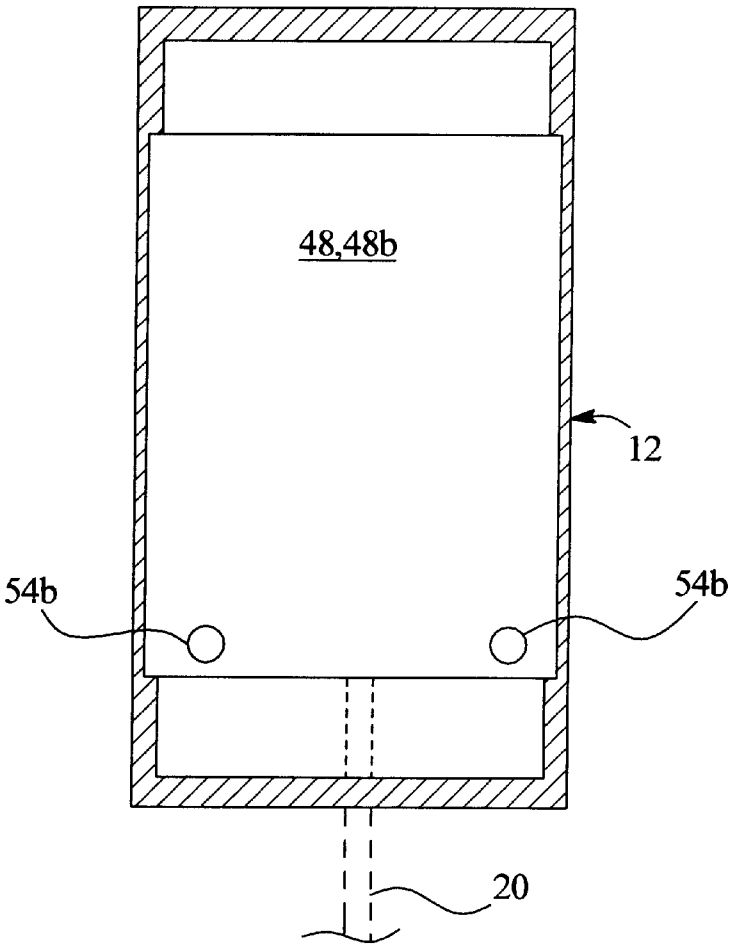
FIG. 6 is a cross-sectional view of another embodiment of the lower divider member taken alone line 6—6 of FIG. 3.
Figure 5:
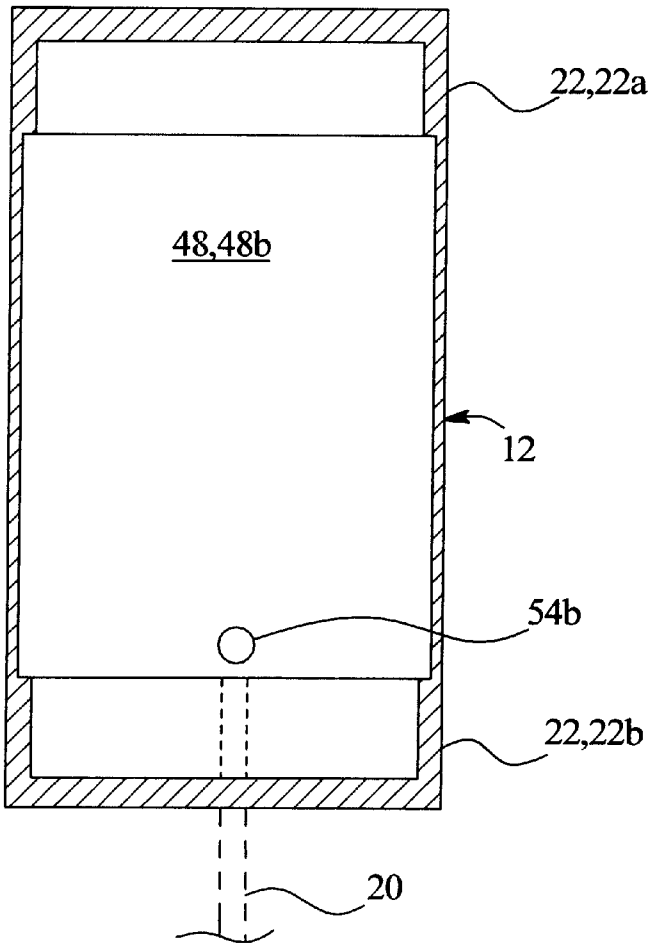
FIG. 5 is a cross-sectional view of one embodiment of a lower divider member taken alone line 5—5 of FIG. 3.

FIGS. 5 and 6 illustrate two embodiments wherein one aperture 54*b* and two apertures 54*b* are provided, respectively. FIGS. 5 and 6 are taken along lines 5—5 and 6—6, respectively, of FIG. 3. As shown in these figures, the divider member aperture 54*b* is preferably positioned so as to be distal from the direct laminar flow of the cooled water returning to the tank 12 through the return inlet 20, most preferably substantially directly above the inlet 20. In other words, as the cooled water returns to the tank 12, the cooled water will naturally flow in a particular direction and, at some point, will tend to flow in an upward direction and contact the divider member 48. By positioning the aperture (s) 54*b* at a location distal from the natural flow of the cooled water, the flow of the cooled water to another region is substantially impeded. It is contemplated that by providing two apertures 54*b*, heated water will flow downwardly through one of the apertures 54*b*, and cooled water will flow upwardly through the other aperture 54*b*.

Stabilizer means for substantially reducing flexure of the side walls of the tank 12 is provided. Flexure of the tank side wall occurs as the pressure within the tank 12 increases and decreases, which is attributed to changes in the temperature of the water. In one embodiment, the stabilizer means includes one or more substantially rigid horizontally extending stabilizers (not shown), preferably metal rods. Each stabilizer includes a first end (not shown) fixedly attached to the inside surface (not shown) of the front wall 53, and includes an opposing end fixedly attached to the inside surface (not shown) of the opposing rear wall (not shown).

To provide a further understanding of the present invention, the following example is provided with the understanding that this example merely demonstrates the implementation of an embodiment of the invention.

EXAMPLE

A 150-gallon once-through, two-pass boiler was constructed in accordance with the teachings provided herein. A natural gas 1-million BTU (British-thermal units) burner with the ⅜" nozzle and a ½" natural gas line inlet was provided for generating and driving heated gas into the combustion conduit of the boiler. The dimensions of the tank were approximately 48"H×36"L×30"W, and contained approximately 150-gallons of regular (light) water. Upper and lower divider members were provided. Upon firing, the boiler generated usable steam in approximately 45 minutes. The temperature of the flue gas exhaust was approximately 250° C. to approximately 270° C.

The foregoing description of an embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims as set forth below.

What is claimed is:

1. An apparatus for transferring heat from a heated gas to a heat transfer medium, comprising:

a tank for holding the heat transfer medium;

a substantially horizontal combustion conduit extending through said tank in heat transfer relationship with the heat transfer medium;

a heat source in communication with said combustion conduit for heating and driving the heated gas into said combustion conduit;

a set of fire conduits extending through said tank below said combustion conduit and in heat transfer relationship with said heat transfer medium and in communication with said combustion conduit; and a tank divider member positioned within said tank between said combustion conduit and said set of fire conduits for dividing said tank into an upper region and a lower region, said divider member having an aperture;

whereby as the heat transfer medium cools, the heat transfer medium passes from said upper region, through said aperture, and to said lower region; and whereby when the heat transfer medium is contained in said tank, and when the heated gas is driven into said combustion conduit, the heated gas flows through said combustion conduit, and then flows downwardly and then substantially transversely through said fire conduits, so as to transfer heat from the heated gas to the heat transfer medium as the heated gas flows through said combustion conduit and said fire conduits.

2. An apparatus for transferring heat from a heated gas to a heat transfer medium, comprising:

a tank for holding the heat transfer medium;

a substantially horizontal combustion conduit extending through said tank in heat transfer relationship with the heat transfer medium;

a heat source in communication with said combustion conduit for heating and driving the heated gas into said combustion conduit;

a set of fire conduits extending through said tank below said combustion conduit and in heat transfer relationship with said heat transfer medium and in communication with said combustion conduit; and a tank divider member positioned within said tank between said combustion conduit and said set of fire conduits for dividing said tank into an upper region and a lower region, said divider member having two apertures;

whereby as the heat transfer medium cools, the heat transfer medium passes from said upper region, through at least one of said apertures, and to said lower region; and whereby when the heat transfer medium is contained in said tank, and when the heated gas is driven into said combustion conduit, the heated gas flows through said combustion conduit, and then flows downwardly and then substantially transversely through said fire conduits, so as to transfer heat from the heated gas to the heat transfer medium as the heated gas flows through said combustion conduit and said fire conduits.

3. The apparatus of claim 2, wherein said tank divider member includes two substantially parallel members having an insulator interposed there between for substantially insulating the heat transfer medium in said upper region from the heat transfer medium in said lower region.

4. The apparatus of claim 3, wherein said tank divider further includes a plurality of stabilizers operably associated with each said parallel member for substantially preventing said parallel members from contacting each other.

5. The apparatus of claim 4, wherein said tank includes an outlet in communication with said upper region and an inlet in communication with said lower region, wherein the heated heat transfer medium is extracted from said tank through said outlet, and cooled heat transfer medium is returned to said tank through said inlet.

6. The apparatus of claim 5, wherein said heat transfer medium is water.

7. The apparatus of claim 6, wherein said heat source includes a burner supplied with a combustible fuel for forming the heated gas, and further includes a blower for driving said heated gas into said combustion conduit.

8. The apparatus of claim 3 wherein the first and second tank divider members each include an inspection aperture for inspecting the divider members.

9. The apparatus of claim 2, which further comprises:

a second set of fire conduits extending through said tank below said first set of fire conduits and in heat transfer relationship with said heat transfer medium and in communication with said first set of fire conduits; and a second tank divider member positioned within said tank between said first set of fire conduits and said second set of fire conduits, said first and second tank divider members dividing the tank into an upper region, a central region located between the first and second tank divider members, and a lower region, said second tank divider member having two apertures, wherein the heat transfer medium passes to and from said central region through said apertures as the heat transfer medium cools.

10. The apparatus of claim 9 wherein said first and second tank divider members each includes two substantially parallel members having an insulator interposed there between for substantially insulating the heat transfer medium in said central region from the heat transfer medium in said lower region and said upper region.

11. The apparatus of claim 10 wherein said first and second tank divider members each includes an inspection aperture for inspecting said first or second divider member.

12. The apparatus of claim 10 wherein said first and second tank divider members further include a plurality of stabilizers operably associated with each said substantially parallel member for substantially preventing said parallel members from contacting each other.

13. The apparatus of claim 9 wherein said tank includes an outlet in communication with said upper region and an inlet in communication with said lower region, wherein the heat transfer medium is extracted from said tank through said outlet, and cooled heat transfer medium is returned to said tank through said inlet.

14. The apparatus of claim 9 which further comprises:

a divided side wall operably associated with said tank having an upper chamber for directing the heated gas from said combustion conduit into said first set of fire conduits, and a lower chamber for directing the heated gas from said second set of fire conduits into an exhaust; and an opposing non-divided sidewall operably associated with said tank having a chamber for directing the heated gas from said first set of fire conduits into said second set of fire conduits.

15. An apparatus for transferring heat from a heated gas to a heat transfer medium, comprising:

a tank for holding the heat transfer medium;

a substantially horizontal combustion conduit extending through said tank in heat transfer relationship with the heat transfer medium;

a heat source in communication with said combustion conduit for heating and driving the heated gas into said combustion conduit;

a first set of fire conduits extending through said tank below said combustion conduit and in heat transfer relationship with said heat transfer medium and in communication with said combustion conduit;

a second set of fire conduits extending through said tank below said first set of fire conduits and in heat transfer relationship with said heat transfer medium and in communication with said first set of fire conduits;

whereby when the heat transfer medium is contained in said tank, and when the heated gas is driven into said combustion conduit, the heated gas flows through said combustion conduit, then flows downwardly and then substantially transversely through said first set of fire conduits, and then flows downwardly and then substantially transversely through said second set of conduits, so as to transfer heat from the heated gas to the heat transfer medium as the heated gas flows through said combustion conduit, said first set of fire conduits and said second set of fire conduits;

a first tank divider member positioned within said tank between said combustion conduit and said first set of fire conduits; and a second tank divider member positioned within said tank between said first set of fire conduits and said second set of fire conduits, said first tank divider and said second tank divider dividing said tank into an upper region, a central region located between said first and second tank dividers, and a lower region, wherein each said tank divider member has an aperture;

whereby the heat transfer medium passes to and from said central region through said aperture as the heat transfer medium cools.

16. The apparatus of claim 15 wherein each tank divider member includes two substantially parallel members having an insulator interposed there between for substantially insulating the heat transfer medium in said central region from the heat transfer medium in said lower region and said upper region.

17. The apparatus of claim 16, wherein each tank divider member further includes a plurality of stabilizers operably associated with each said substantially parallel member for substantially preventing said substantially parallel members from contacting each other.

18. The apparatus of claim 17, wherein said tank includes an outlet in communication with said upper region and an inlet in communication with said lower region, wherein the heated heat transfer medium is extracted from said tank through said outlet, and cooled heat transfer medium is returned to said tank through said inlet.

19. The apparatus of claim 16 wherein the first and second tank divider members each include an inspection aperture for inspecting the divider members.

20. The apparatus of claim 15, wherein said apparatus further comprises:

a divided side wall operably associated with said tank having an upper chamber for directing the heated gas from said combustion conduit into said first set of fire conduits, and a lower chamber for directing the heated gas from said second set of fire conduits into an exhaust; and an opposing non-divided sidewall operably associated with said tank having a chamber for directing the heated gas from said first set of fire conduits into said second set of fire conduits.

21. An apparatus for transferring heat from a heated gas to a heat transfer medium, comprising:

a tank for holding the heat transfer medium;

a combustion conduit extending through said tank in heat transfer relationship with the heat transfer medium;

a heat source in communication with said combustion conduit for heating and driving the heated gas into said combustion conduit; and a first set of downwardly angled fire conduits extending through said tank below said combustion conduit and in heat transfer relationship with said heat transfer medium and in communication with said combustion conduit, wherein said first set of downwardly angled fire conduits are angled between 1 and 45 degrees relative to said combustion conduit; and a tank divider member positioned within said tank between said combustion conduit and said first set of fire conduits for dividing said tank into an upper region and a lower region, said divider member having an aperture;

whereby when the heat transfer medium is contained in said tank, and when the heated gas is driven into said combustion conduit, the heated gas flows through said combustion conduit, and then flows downwardly through said first set of downwardly angled fire conduits, so as to transfer heat from the heated gas to the heat transfer medium as the heated gas flows through said combustion conduit and said first set of downwardly angled fire conduits.

22. The apparatus of claim 21 which further comprises:

a second set of downwardly angled fire conduits extending through said tank below said first set of downwardly angled fire conduits and in heat transfer relationship with said heat transfer medium and in communication with said first set of downwardly angled fire conduits, wherein said second set of downwardly angled fire conduits are angled between 1 and 45 degrees relative to said combustion conduit; and a second tank divider member positioned within said tank between said first set of downwardly angled fire conduits and said second set of downwardly angled fire conduits, said first and second tank dividers dividing the tank into an upper region, a central region located between the first and second tank dividers, and a lower region, said second tank divider member having an aperture, wherein the heat transfer medium passes to and from said central region through said apertures as the heat transfer medium cools.

23. The apparatus of claim 22 wherein the first and second divider members each comprises at least two apertures.

24. The apparatus of claim 21 wherein the first divider member comprises at least two apertures.

* * * * *